US009766580B2

(12) United States Patent
Hashimoto et al.

(10) Patent No.: US 9,766,580 B2
(45) Date of Patent: Sep. 19, 2017

(54) FIXING DEVICE

(71) Applicant: Brother Kogyo Kabushiki Kaisha, Nagoya (JP)

(72) Inventors: Yohei Hashimoto, Nagakute (JP); Wen Chen, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 15/273,758

(22) Filed: Sep. 23, 2016

(65) Prior Publication Data

US 2017/0090373 A1 Mar. 30, 2017

(30) Foreign Application Priority Data

Sep. 29, 2015 (JP) ..... 2015-190981

(51) Int. Cl.
*G03G 15/20* (2006.01)

(52) U.S. Cl.
CPC ..... *G03G 15/2085* (2013.01)

(58) Field of Classification Search
CPC ..... G03G 15/2067; G03G 15/2071; G03G 15/2085
USPC ..... 399/322, 328, 329
See application file for complete search history.

(56) References Cited

U.S. PATENT DOCUMENTS

2009/0226227 A1 9/2009 Furukata et al.
2011/0170920 A1* 7/2011 Fujiwara ..... G03G 15/2064 399/331
2011/0222874 A1* 9/2011 Yamada ..... G03G 15/2085 399/33
2014/0064763 A1* 3/2014 Watanabe ..... G03G 15/2067 399/67
2014/0270875 A1* 9/2014 Mimbu ..... B66F 19/00 399/329

FOREIGN PATENT DOCUMENTS

JP 4557023 B2 10/2010
JP 5481363 B2 4/2014
JP 2014-089238 A 5/2014
JP 5611183 B2 10/2014

* cited by examiner

*Primary Examiner* — Sandra Brase
(74) *Attorney, Agent, or Firm* — Burr & Brown, PLLC

(57) ABSTRACT

A fixing device having a cam and a contact member is configured to satisfy:

$$D4>D2, \text{ and}$$

$$D3-D4<D1-D2,$$

where D1 and D2 are distances viewed along the rotation axis of the cam in a first state where a curved surface of the contact member engages with the first concave portion on of a cam, and D3 and D4 are distances viewed along the rotation axis in a second state where the curved surface engages with a second concave portion of the cam, D1 represents a distance from a most upstream contact point in the rotation direction to the rotation axis, D2 represents the shortest distance from the rotation axis to the curved surface, D3 represents a distance from a most upstream contact point in the rotation direction of the cam to the rotation axis, and D4 represents the shortest distance from the rotation axis to the curved surface.

15 Claims, 9 Drawing Sheets

FIXING DEVICE

CROSS-REFERENCE TO RELATED APPLICATION

This application claims priority under 35 U.S.C. §119 from Japanese Patent Application No. 2015-190981 filed on Sep. 29, 2015. The entire subject matter of the application is incorporated herein by reference.

BACKGROUND

Technical Field

The present disclosures relate to a fixing device configured to thermally fix a developer image which has been transferred onto a recording sheet.

Related Art

Conventionally, there has been known a fixing device for an electrophotographic imaging apparatus in which a nip pressure between a heat roller and a pressure roller is switched in multiple steps using a motor and a cam. In such a fixing device, two concave portions are formed on an outer peripheral surface of the cam to engage with a roller which serves as a contacting member. By making the roller to selectively engage with one of the concave portions, an orientation of the cam is stabilized, thereby the nip pressure at a nip between the heat roller and the pressure roller being stabilized.

SUMMARY

In the conventional fixing device as described above, a driving torque of the cam when the nip pressure is changed (i.e., the torque required to make the roller move away from the concave portion on the outer circumferential surface of the cam) is not considered, and there is a possibility that the driving torque may become unnecessarily large.

In view of the above, aspects of the disclosures provide an improved fixing device in which the driving torque of the cam is prevented from becoming too large, with realizing the stabilized nip pressure.

According to aspects of the disclosures, there is provided a fixing device configured to thermally fix a developer image on a recording sheet, which is provided with a heating member, a backup member configured to nip the recording sheet in association with the heating member, a supporting member configured to support one of the heating member and the backup member, a pressing member configured to urge another of the heating member and the backup member toward the one of the heating member and the backup member, an urging member configured urge the pressing member toward the supporting member, a cam provided to the one of the supporting member and the pressing member, and a contacting member having a curved surface to contact an outer periphery of the cam and provided to the other of the supporting member and the pressing member. The cam has at least two concave portions formed on the outer periphery of the cam at different portions apart from each other in a rotation direction of the cam, each of the at least two concave portions being configured to contact and engage with the curved surface, and the at least two concave portions include a first concave portion and a second concave portion which is spaced from the first concave portion in the rotation direction of the cam by a particular amount. The fixing device is configured to satisfy following relationships:

$$D4>D2, \text{ and}$$

$$D3-D4<D1-D2,$$

where D1 and D2 are distances viewed along the rotation axis of the cam in a first state in which the curved surface engages with the first concave portion, D3 and D4 are distances viewed along the rotation axis of the cam in a second state in which the curved surface engages with the second concave portion, D1 represents a first distance which is a distance from a most upstream contact point in the rotation direction to a rotation axis of the cam which is the center of rotation of the cam, D2 represents a second distance which is the shortest distance from the rotation axis to the curved surface, D3 represents a third distance which is a distance from a most upstream contact point in the rotation direction of the cam to the rotation axis in a second state in which the curved surface engages with the second concave part, and D4 represents a fourth distance which is the shortest distance from the rotation axis to the curved surface.

According to the above configuration, since the orientation of the cam is stabilized as the contact member engages with the concave portion of the cam surface, thereby the nip pressure between the heating member and the pressure member being stabilized. Further, since D4>D2, in the second state, the cam moves the contacting member to separate from the rotation axis of the cam against the urging force by the urging member by a distance greater than the one in the first state. Therefore, the urging force by the urging member is large in the second state, and a greater force is necessary to rotate the cam in the second state than in the first state. However, since D3−D4<D1−D2 is satisfied, that is, since the head of the concave portion at the upstream side in the rotation direction of the cam, which the curved surface of the contacting member is to get over, is smaller in the second state than that in the first state, the driving torque of the cam can be lessened in comparison with a case where the heads are the same. Accordingly, it is possible to prevent the driving torque of the cam from increasing unnecessarily.

According to aspects of the disclosures, it is possible that the nip pressure is stabilized, and the driving torque of the cam is prevented from becoming too large.

BRIEF DESCRIPTION OF THE ACCOMPANYING DRAWINGS

FIG. 1 is a cross-sectional side view schematically illustrating a configuration of a laser printer provided with a fixing device, according to an illustrative embodiment of the disclosures.

FIG. 2 schematically shows a configuration of the fixing device according to the illustrative embodiment of the disclosures.

DETAILED DESCRIPTION OF THE EMBODIMENTS

Referring to the accompanying drawings, an illustrative embodiment and a modification thereof will be described. In the following description, an overall configuration of a laser printer 1 having a fixing device 100 according to the illustrative embodiment will be described firstly, and a configuration of the fixing device 100 will be described in detail thereafter.

<Overall Configuration of Laser Printer>

Figure 1:
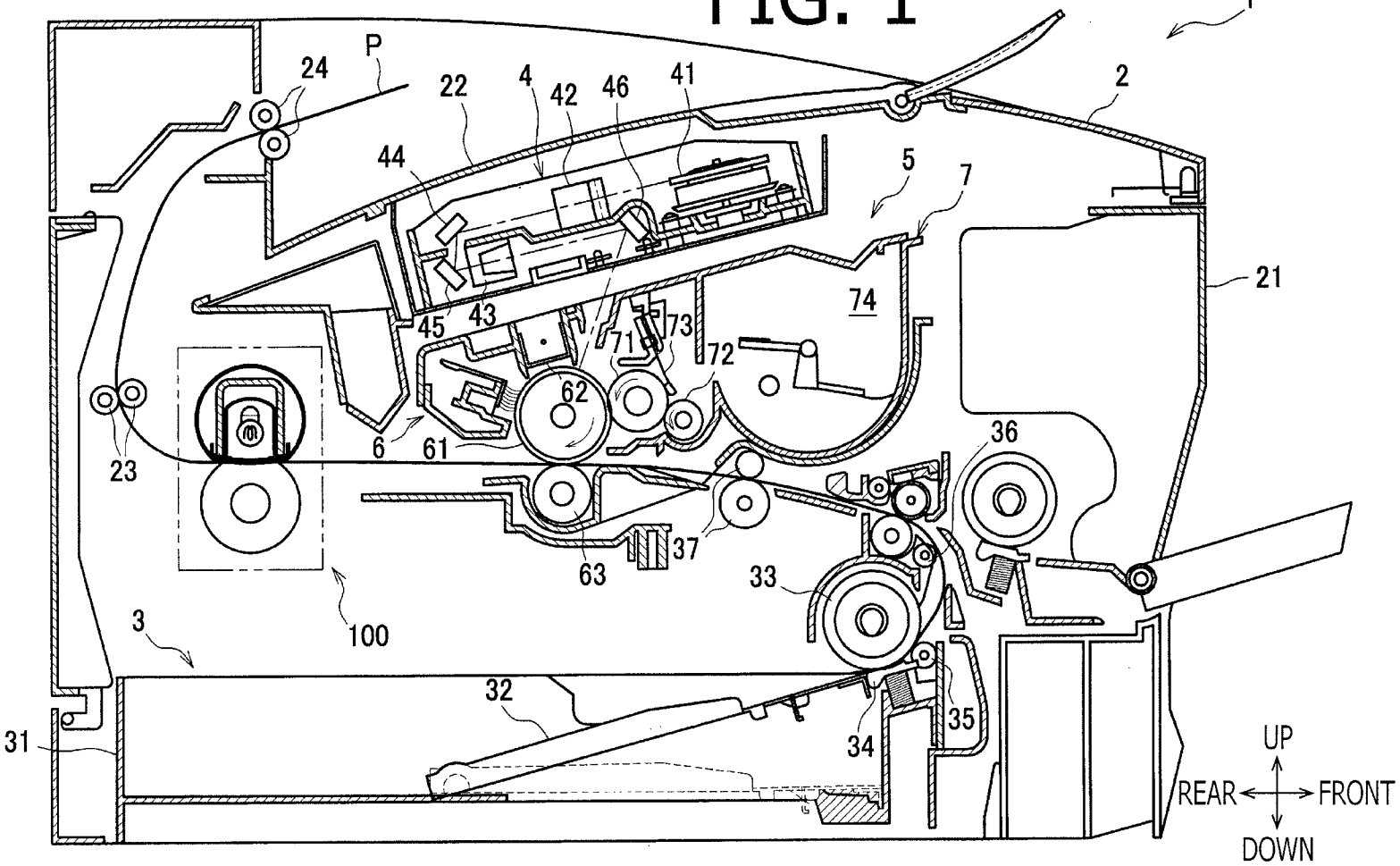

As shown in FIG. 1, the laser printer 1 has a housing 2, which accommodates a sheet feeding device 3 configured to feed a sheet P (which is an example of a recording sheet), an exposure device 4, a process cartridge 5 configured to transfer a developer image (e.g., a toner image) on the sheet P, and the fixing device 100 configured to thermally fix the developer image (e.g., the toner image) on the sheet P.

In the following description, directions are indicated with reference to a viewpoint of a user who is using the laser printer 1. For example, a right-hand side of FIG. 1 will be referred to as a "front" side of the laser printer 1, a left-hand side of FIG. 1 will be referred to as a "rear" side of the laser printer 1, a closer side with respect to a plane of FIG. 1 will be referred to as a "left" side of the laser printer 1, and a farther side with respect to the plane of FIG. 1 will be referred to as a "right" side of the laser printer 1. Further, an up and down sides of FIG. 1 will be referred to as up and down sides of the laser printer 1, respectively.

The sheet feeding device 3 is arranged at a lower portion inside the housing 2. The sheet feeding device 3 is mainly provided with a sheet feed tray 31 accommodating the sheets P, a pressure plate 32 configured to lift up a front end portion of the sheets P, a feed roller 33, a sheet feed pad 34, paper powder removing rollers 35 and 36, and a registration roller pair 37. The sheets P accommodated in the sheet feed tray 31 are urged toward the feed roller 33, and fed one by one as being separated by the feed roller 33 in association with the sheet feed pad 34. The sheet P is then conveyed toward the process cartridge 5 via the paper powder removing rollers 35 and 36, and the registration roller pair 37.

The exposure device 4 is arranged at an upper portion inside the housing 2, and is mainly provided with a laser source (not shown), a rotatable polygonal mirror 41, lenses 42 and 43, and reflectors 44, 45 and 46. In the exposure device 4, a laser beam, which is indicated by chained lines in FIG. 1, modulated based on image data and emitted by the laser source, is reflected/refracted by the polygonal mirror 41, the lens 42, the reflector 44 and 45, the lens 43 and the reflector 46, in this order, and is scanned on a circumferential surface of a photosensitive drum 61 at a high speed.

The process cartridge 5 is arranged below the exposure device 4. The process cartridge 5 is detachably attached to the housing 2 through an opening which is provided to the housing 2 and normally covered with a front cover 21, and can be detached (i.e., withdrawn) from the housing 2 through the opening when the front cover 21 is opened.

The process cartridge 5 includes a drum unit 6 and a developer unit 7. The drum unit 6 includes the photosensitive drum 61, a charger 62 and a transfer roller 63. The developer unit 7 is configured to be detachably attached to the drum unit 6, and includes a developing roller 71, a supplying roller 72, a layer thickness regulating blade 73, and a toner container 74 accommodating toner (or, developer) therein.

In the process cartridge 5, a circumferential surface of the photosensitive drum 61 is uniformly charged with use of the charger 62. Thereafter, the charged surface of the photosensitive drum 61 is exposed to the scanning laser beam which is emitted by the exposure device 4, thereby an electrostatic latent image being formed on the circumferential surface of the photosensitive drum 61 based on the image data. The toner, which is an example of developing agent, contained in the toner container 74 is supplied to the developing roller 71 via the supplying roller 72 and enters a portion between the developing roller 71 and the layer thickness regulating blade 73. The thickness of the toner is regulated by the developing roller 71 and the layer thickness regulating blade 73, thereby the toner being held by the developing roller 71 as a thin layer having a fixed thickness.

The toner carried by the developing roller 71 is supplied to the electrostatic latent image formed on the circumferential surface of the photosensitive drum 61, thereby the electrostatic latent image being developed and a toner image, which is an example of a developer image, being formed on the photosensitive drum 61. Thereafter, when the sheet P is conveyed between the photosensitive drum 61 and the transfer roller 63, the toner image (which is an example of a developer image) is transferred to the sheet P.

The fixing device 100 is arranged on the rear side with respect to the process cartridge 5. The toner image transferred to the sheet P is thermally fixed on the sheet P as the sheet passes through the fixing device 100. The sheet P, on which the toner image has been thermally fixed, is discharged onto a discharge tray 22 by conveying rollers 23 and 24.

<Detailed Configuration of Fixing Device>

Figure 2:
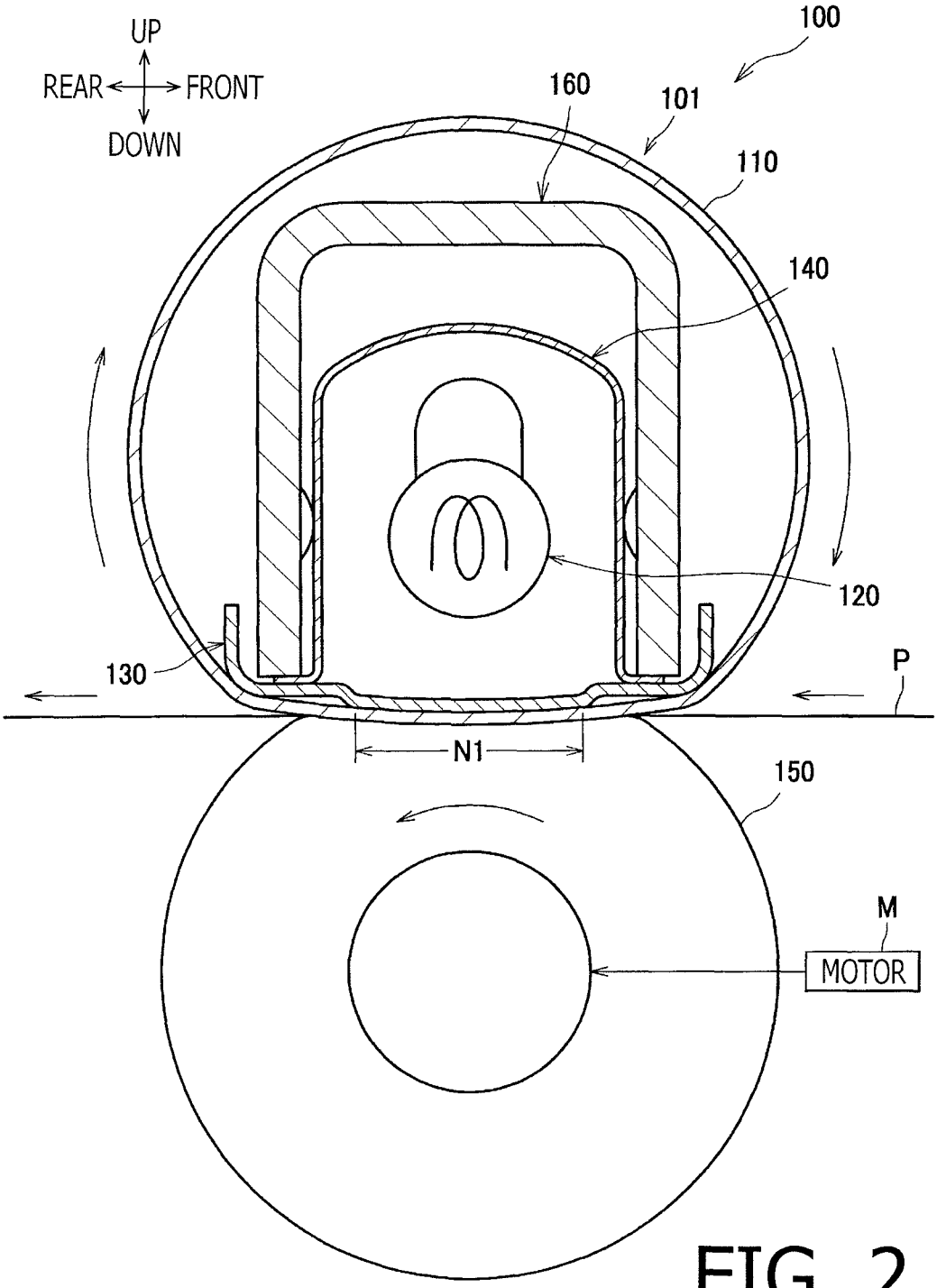

As shown in FIG. 2, the fixing device 100 has a heating member 101 and a pressure roller 150, which is an example of a backup member. The heating member 101 has a fixing belt 110, a halogen lamp 120 which is an example of a heating element, a nipping plate 130 which is an example of a nipping member, a reflection plate 140 and a stay 160.

The fixing belt 110 is an endless (cylindrical) belt having heat resisting property and plasticity. Both side ends of the fixing belt 110 are guided by guide members 170 when the fixing belt 110 rotates.

The halogen lamp 120 is a heating element functions to heat the toner on the sheet P by applying heat to the nipping plate 130 and the fixing belt 110. The halogen lamp 120 is arranged at an inner side of the cylinder-shaped fixing belt 110 as shown in FIG. 2 with a certain clearance being provided from an inner surface of the fixing belt 110 and the nipping plate 130.

The nipping plate 130 is a plate member and serves to receive radiant heat from the halogen lamp 120. As shown in FIG. 2, the nipping plate 130 is configured to slidably contact the inner surface of the fixing belt 110, and transmits the radiant heat received from the halogen lamp 120 to the toner on the sheet P via the fixing belt 110.

The reflection plate 140 is configured to reflect the radiant heat (mainly, front, rear, upward and downward components thereof) from the halogen lamp 120 toward the nipping plate 130. The reflection plate 140 is arranged on the inner side of the cylindrically-shaped fixing belt 110 to surround the halogen lamp 120 with a certain clearance therebetween.

The pressure roller 150 sandwiches, in association with the nipping plate 130, the fixing belt 110 and the sheet P, thereby defining a nip portion N1 between the pressure roller 150 and the fixing belt 110. As shown in FIG. 2, the pressure roller 150 is arranged below the nipping plate 130.

The pressure roller 150 is configured to receive a driving force from a motor M arranged inside the housing 2. As the pressure roller 150 is driven to rotate, the fixing belt 110 is driven to proceed (i.e., rotate) by a frictional force therebetween. As the sheet P on which the toner image has been transferred is conveyed in the nip portion N1, which is defined between the pressure roller 150 and the fixing belt 110, and heated, the toner image is thermally fixed on the sheet P.

The stay 160 is a member to retain rigidity of the nipping plate 130 by supporting the nipping plate 130 at both ends, together with the reflection plate 140, in the front-rear direction. The stay 160 has a shape corresponding to the outer shape of the reflection plate 140 (i.e., substantially U-shaped in cross section) and is arranged to cover the reflection plate 140.

Figure 3:
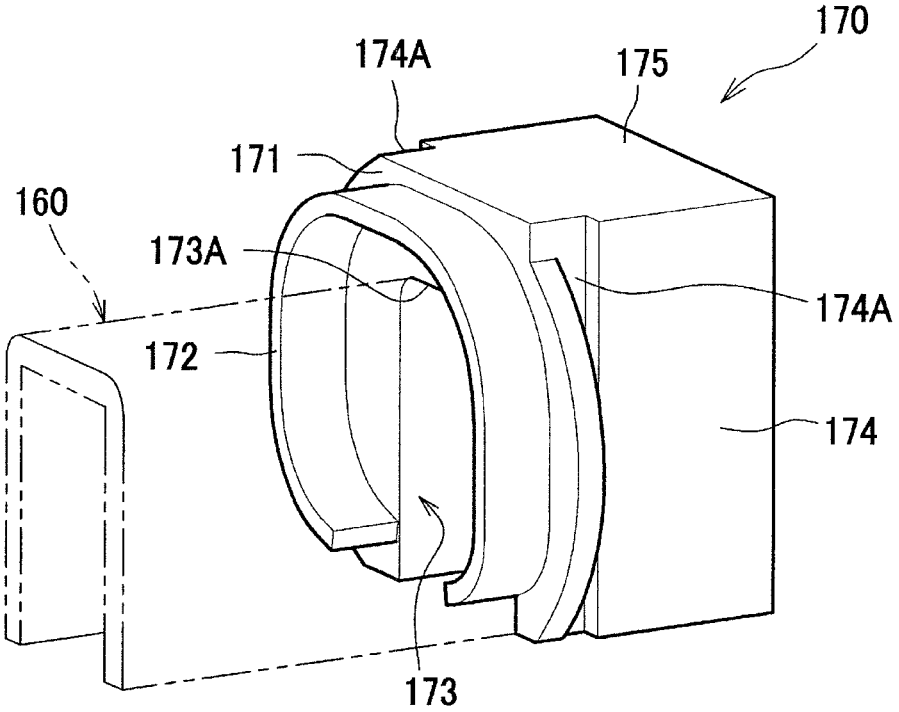
FIG. 3 is a perspective view of a guide member according to the illustrative embodiment of the disclosures.

The nipping plate 130, the stay 160 that holds the reflection plate 140 and the halogen lamp 120 are directly fixed to guide members 170, one of which is shown in FIG. 3. In other words, the guide members 170 integrally support the nipping plate 130, the reflection plate 140, the stay 160 and the halogen lamp 120.

The guide members 170 are made of insulation material such as resin. There are two guide members 170 which are arranged corresponding to both ends (in the right-left direction) of the fixing belt 110, respectively, to mainly serve to regulate movement of the fixing belt 110 in the right-left direction. Specifically, each guide member 170 is configured to have a regulating surface 171 which regulates displacement of the fixing belt 110 in the right-left direction, a suppression portion 172 which serves to suppress inward deformation of the fixing belt 110 in the radial direction, and a holding recess 173 that holds each end of the stay 160.

The holding recess 173 is a groove configured to open downward, and pierced in the right-left direction. Two facing side walls 174, which face in the front-rear direction, among walls defining the holding recess 173 are formed with guide grooves 174A extending in the up-down direction.

Figure 4:
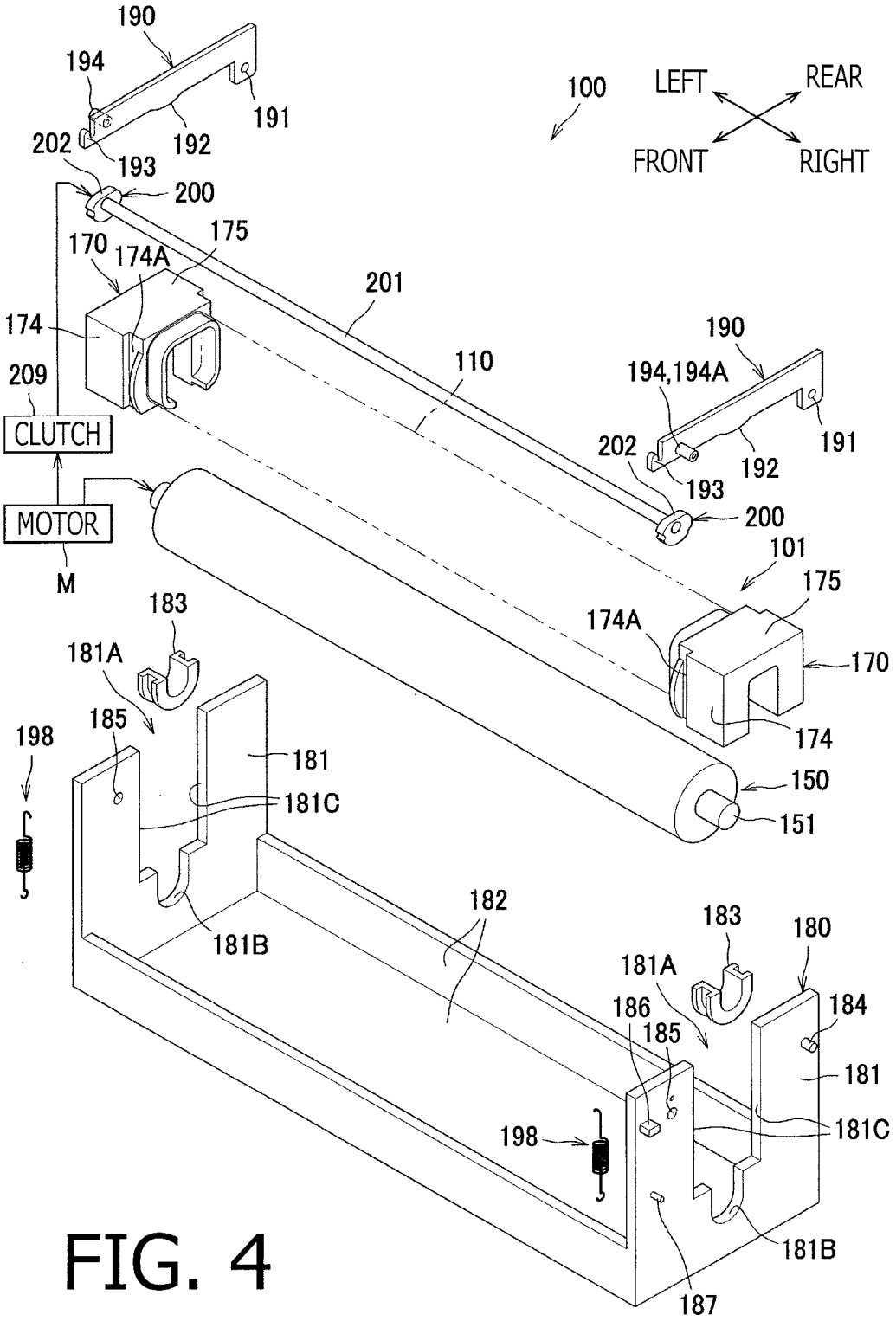
FIG. 4 is an exploded perspective view showing main components of the fixing device according to the illustrative embodiment of the disclosures.

As shown in FIG. 4, the fixing device 100 is provided with a fixing frame 180 which is an example of a supporting member and is fixed to the housing 2, a pair of rotatable arms 190 which is an example of pressing members, a pair of tension springs 198 which is an example of an urging member that urges the pressing member toward the supporting member (i.e., the fixing frame 180), and right and left cams 200 which are connected by a shaft 201.

The fixing frame 180 rotatably supports the pressure roller 150, and guides the movement of the heating member 101 in the up-down direction. The fixing frame 180 has right and left side walls 181, and a connector 182 connecting the right and left side walls 181. Each of the right and left side walls 181 has a concave portion 181A formed to be recessed downward from the upper end of each side wall 181. At a bottom of the concave portion 181A, a semi-circular bearing 181B is formed. In each bearing 181B, a U-shaped bearing member 183 is fitted. The bearings 181B support the shaft 151 of the pressure roller 150 from below via the bearing members 183.

An upper part of each of the side walls 181 above the concave portion 181A is configured to constitute a pair of rails 181C extending upward straightly. Each pair of rails 181C is fitted in the pair of guide grooves 174A provided to each of the right and left guide members 170, thereby the heating member 101 being movable upward/downward along the pair of rails 181C formed on each of the side walls 181.

In front of each of the concave portions 181A of the side walls 181, a supporting hole 185 to rotatably support the shaft 201 of the cams 200 is formed. Further, on an outer surface of each of the side walls 181, a supporting shaft 184 to rotatably support the rotatable arm 190, a stopper 186 to restrict a downward movement of the rotatable arm 190, and a spring hook 187 to which a lower end of the tension spring 198 is hooked are formed to protrude from the surface of each side wall 181. In FIG. 4, the above configuration is shown only on the outer surface of the right side wall 181.

Each of the rotatable arms 190 is a plate member elongated in the front-rear direction. A hole 191 is formed on a rear portion of each rotatable arm 190. As each hole 191 is engaged with the corresponding supporting shaft 184 of the fixing frame 180, the rotatable arms 190 are rotatably supported by the fixing frame 180. On a lower surface of each rotatable arm 190, a contact portion 192 which is a curved portion (e.g., an arc-shaped portion) swelling downward is formed. Each contact portion 192 contacts the upper surface 175 of the corresponding guide member 170, and supports the heating member 101 by applying a force to the guide member 170 from the above. At a front end of each rotatable arm 190, a hook 193 to which the upper end of the tension spring 198 is to be hooked is formed. On the outer surface of each of the rotatable arms 190, a roller 194, which protrudes outward, is provided between the contact portion 192 and the hook 193. The roller 194 is rotatable with respect to the rotatable arm 190, and the outer circumferential of the roller 194, which is a curved surface that can contact the cam surface 202, is formed as a cylindrical surface 194A.

The motor M for driving the pressure roller 150 is connected to the pressure roller 150 via a first transmission mechanism (not shown), and connected to the cam 200 via a second transmission mechanism (not shown) and a clutch 209 which is controlled by a controller (not shown). That is, the motor M which is used to drive the cam 200 is also used to drive the pressure roller 150 which is an element different from the cam 200. The controller controls the motor M and the clutch 209 such that the clutch 209 is connected to the cam 200 at an appropriate timing for a necessary period of time to use the driving force generated by the motor M.

Figure 5:
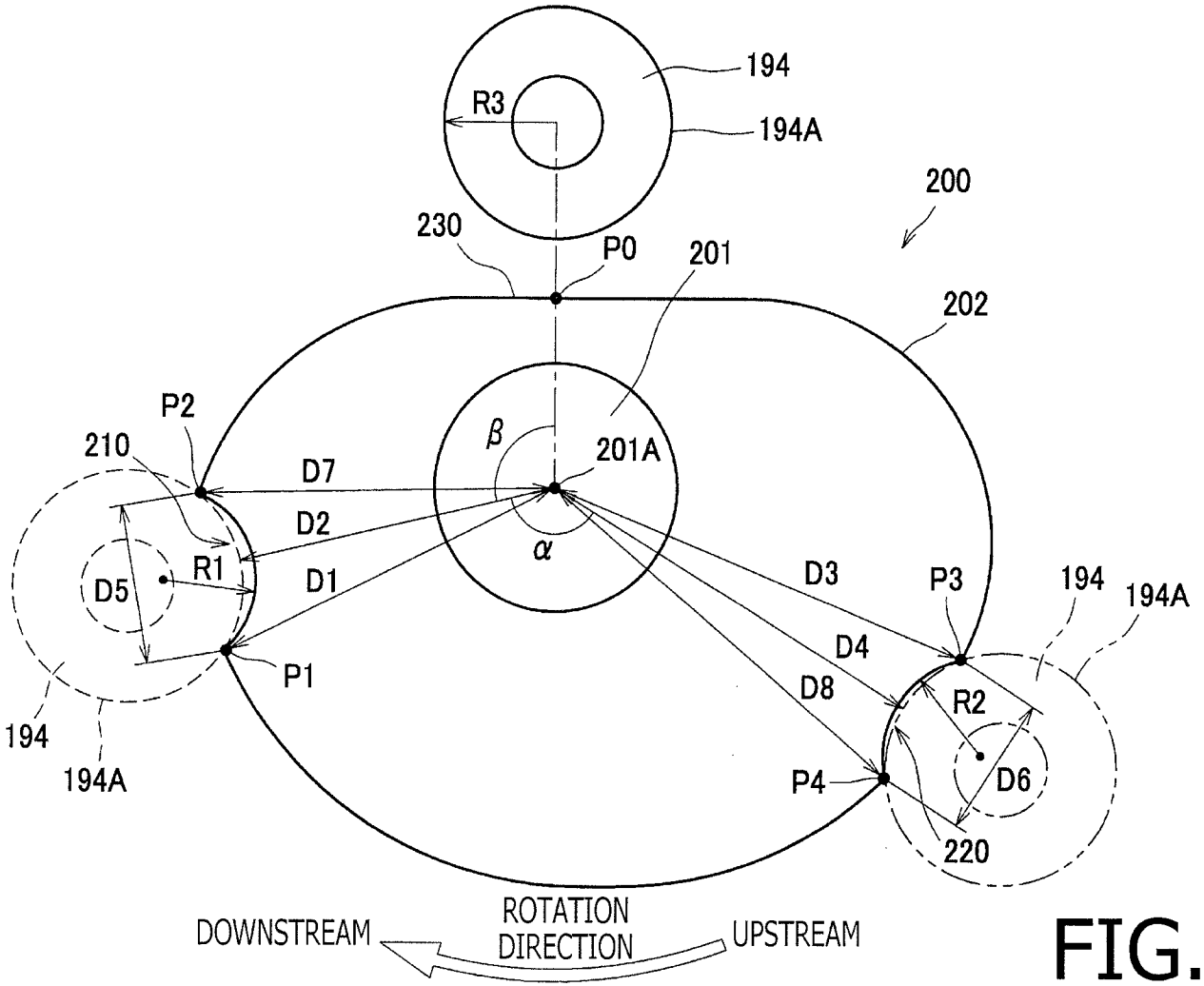
FIG. 5 is an enlarged view of the cam and a contact member according to the illustrative embodiment of the disclosures.

As shown in FIG. 5 in an enlarged manner, the cam 200 has a first concave part 210 and a second concave part 220 which is apart from the first concave part 210 in the rotation direction of the cam 200. According to the present embodiment, the cam 200 is configured to rotate clockwise in FIG. 5, and the second concave part 220 is formed at an upstream side with respect to the first concave part 210 in the rotation direction of the cam 200 (see FIG. 5). When viewed along a rotation axis 201A of the cam 200 (i.e., in a direction perpendicular to a plane of FIG. 5), the first concave part 210 has an arc-shape of which radius of curvature is R1, while the second concave part 220 has an arc-shape of which radius of curvature is R2. A cylindrical surface 194A of the roller 194 has, when viewed along the rotation axis 201A, a shape of a circle of which radius of curvature is R3. Further, the radiuses of curvatures R1, R2 and R3 satisfy the following relationship:

$$R3>R2>R1.$$

Thus, the first concave part 210 contacts the cylindrical surface 194A at two different positions which are shifted in the rotation direction of the cam 200 (i.e., contact points P1 and P2) and engages therewith, and the second concave part 220 contacts the cylindrical surface 194A at two different positions which are shifted in the rotation direction of the cam 200 (i.e., contact points P3 and P4) and engages therewith.

Further, the following relationships are satisfied:

$$D4>D2; \text{ and}$$

$$D3-D4<D1-D2,$$

where, D1 represents, when the cam 200 is in a first state in which the cylindrical surface 194A engages with the first concave part 210 (see the roller 194 indicated by broken lines in FIG. 5), a first distance which is a distance from the contact point P1 on the upstream side in the rotation direction to a rotation axis 201A which is the center of rotation of the cam 200, and D2 represents, when the cam 200 is in the first state, a second distance which is the shortest distance from the rotation axis 201A to the cylindrical surface 194A. Further, D3 represents, when the cam 200 is in a second state in which the cylindrical surface 194A engages with the second concave part 220 (see the roller 194 indicated by two-dotted lines in FIG. 5), a third distance which is a distance from a contact point P3 on the upstream side in the rotation direction to the rotation axis 201A, and D4 represents, when the cam 200 is in the second state, a fourth distance which is the shortest distance from the rotation axis 201A to the cylindrical surface 194A.

Further, D3-D4 represents a head which the roller 194 in the second state should get over to pass the contact point P3 on the upstream side is smaller than D1-D2 which represents a head the roller 194 in the first state should get over to pass the contact point P1 on the upstream side.

Furthermore, the following relationship is also satisfied:

$$D5>D6,$$

where, D5 represents a fifth distance which is a distance from the contact point P1 on the upstream side to a contact point P2 which is the most downstream side contact point in the rotation direction in the first state, and D6 represents a sixth distance which is a distance from the most upstream contact point P3 to the most downstream side contact point P4 in the rotation direction in the second state, when viewed along the rotation axis 201A of the cam 200.

That is, an amount of a part of the roller 194 entering the first concave part 210 in the first state (i.e., the amount of the part of the roller 194 located on the rotation axis 201A side with respect to a line segment P1-P2) is greater than an amount of a part of the roller 194 entering in the second concave part 220 in the second state (i.e., the amount of the part of the roller 194 located on the rotation axis 201A side with respect to a line segment P3-P4).

Furthermore, the following relationships are also satisfied:

$$D1>D7; \text{ and}$$

$$D3>D8,$$

where, D7 represents a seventh distance which is a distance from the most downstream contact point P2 in the rotation direction to the rotation axis 201A viewed along the rotation axis 201 in the first state, D8 represents an eighth distance which is a distance from the most downstream contact point P4 in the rotation direction to the rotation axis 201A in the second state.

When the normal printing is executed, the cam 200 is driven by the control device such that the roller 194 is located, relative to the cam 200, at a position indicated by solid lines in FIG. 5. In this state, the cam surface 202 of the cam 200 is out of contact with the roller 194, which will be referred to as a third state.

In the third state, an opposite surface part 230 of the cam surface 202 facing the cylindrical surface 194A is formed to be a planer surface. In the third state in which the opposite surface part 230 faces the cylindrical surface 194A, the cam 200 does not push up the roller 194. Therefore, in the third state, a nipping force between the heating member 101 and the pressure roller 150 is larger than the same in the first state. Further, the third distance D3 and the eighth distance D8 are determined, that is, the lifting amount of the cam 200 at the second concave part 220 is determined such that the heating member 101 is separated from the pressure roller 150 in the second state.

Further, it is noted that a rotation angle $\alpha$ of the cam 200 from the first state to the second state is greater than a rotation angle $\beta$ of the cam 200 from the third state to the first state. Therefore, when the state is changed from the first state to the second state, even if it is necessary to lift the roller 194 by a relatively large amount, lifting is achieved with a large rotation angle, and it becomes possible to suppress a rotation torque of the cam 200 from becoming excessively large.

Figure 6:
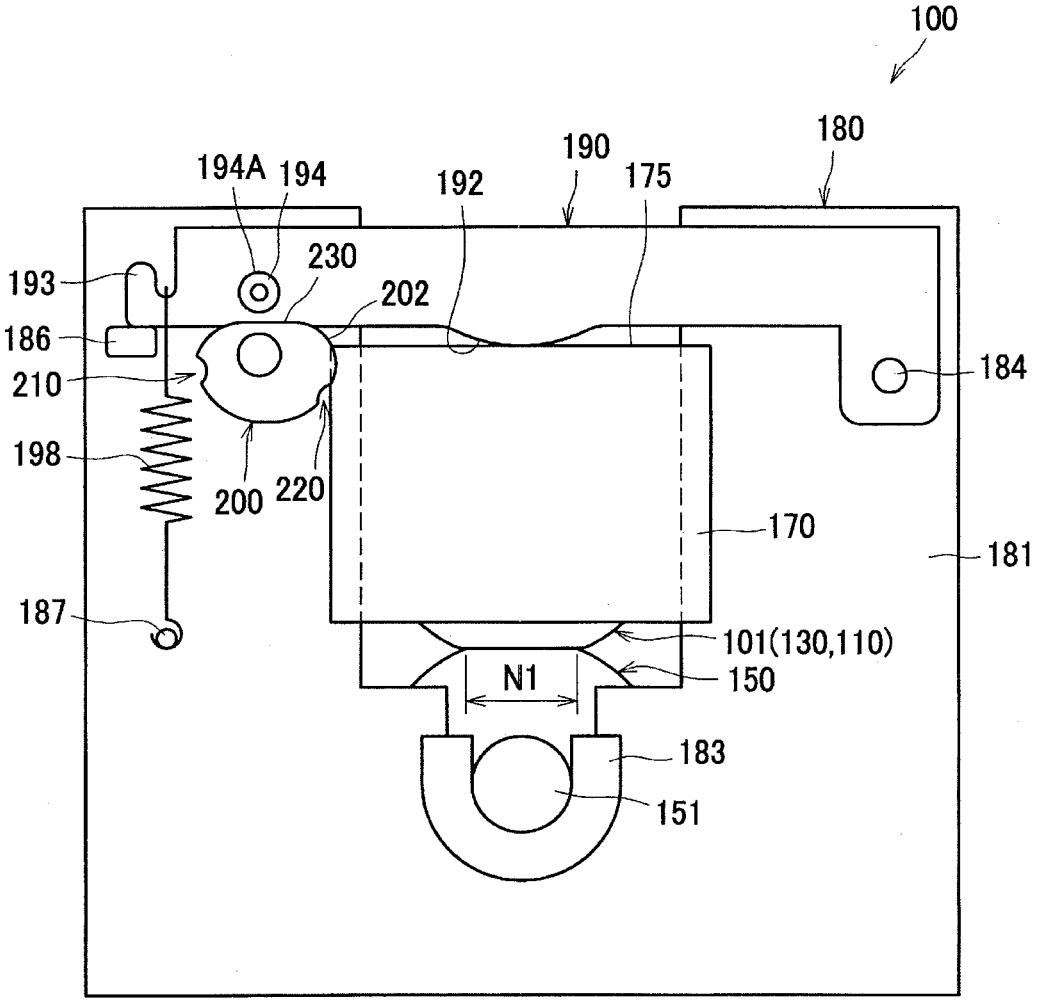
FIG. 6 is a side view of the fixing device in a normal nip state according to the illustrative embodiment of the disclosures.

An operation of the fixing device 100 in the laser printer 1 will be described in detail below. As shown in FIG. 6, in the third state (i.e., when the normal printing is executed), the opposite surface part 230 faces the cylindrical surface 194A of the roller 194, and the cam surface 202 is spaced from the cylindrical surface 194A. Therefore, the cam surface 202 does not prevent a force applied by the tension spring 198 to urge the rotatable arm 190 downward (i.e., on the side where the pressure roller 150 is supported).

Because of the above configuration, the lower surface of the hook 193 contacts the upper surface of the stopper 186 and the attitude of the rotatable arm 190 is determined. Further, the contact portion 192 contacts the upper surface 175 of the guide member 170 to urge the guide member downward. As a result, the nipping plate 130 and the fixing belt 110 are urged by the pressure roller, thereby the nip portion N1 being formed between the pressure roller 150 and the fixing belt 110. At this stage, since the urging force by the tension spring 198 is not suppressed, a width of the nip portion N1 is relatively large. This state will be referred to as a strong nipping state.

Figure 7A:
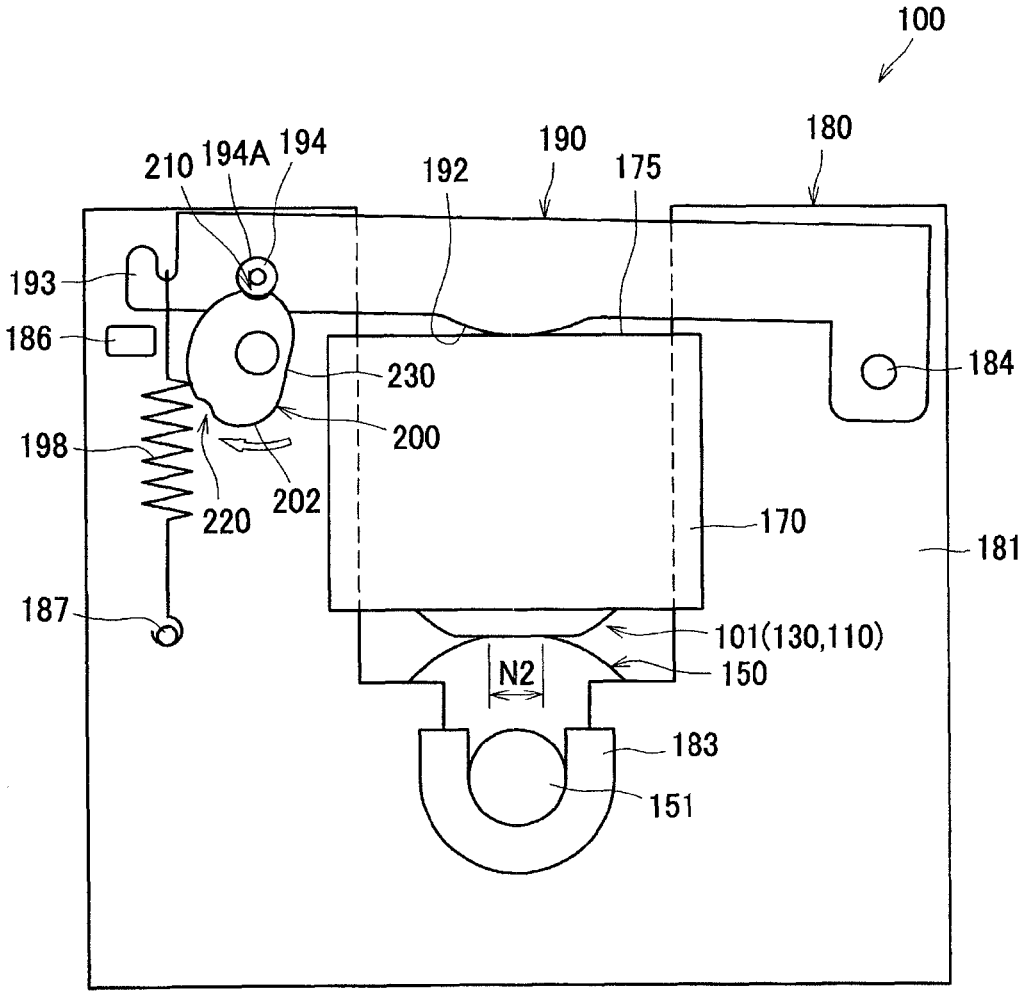
FIG. 7A is a side view of the fixing device in a weak nip state according to the illustrative embodiment of the disclosures.

As the motor M is driven by the controller and the clutch 209 is being connected for a particular period of time, the cam 200 in a state shown in FIG. 6 starts rotating clockwise, and the cam surface 202 pushes up the roller 194 and the roller 194 engages with the first concave part 210 as shown in FIG. 7A. As the roller 194 engages with the first concave part 210, the orientation of the cam 200 is stabilized, thereby the nipping force between the heating member 101 and the pressure roller 150 being stabilized.

Figure 7B:
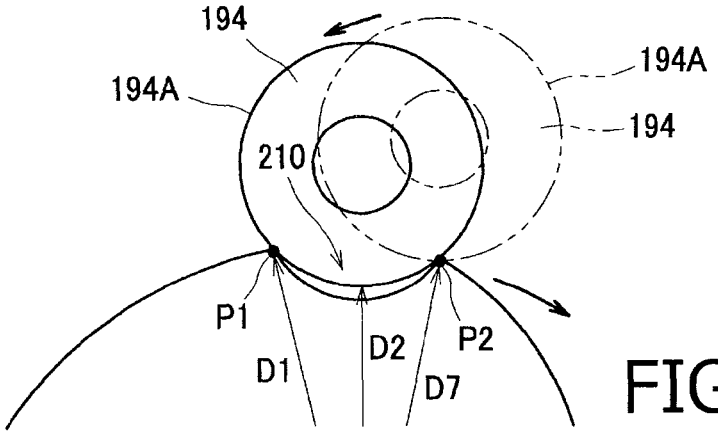
FIG. 7B is a partially enlarged side view showing a state where the roller engages with a first concave portion according to the illustrative embodiment of the disclosures.

In the above-described movement, since the roller 194 is rotatable and rotates on the cam surface 202, the first state is changed to the first state smoothly. As shown in FIG. 7B, since the first distance D1 is equal to or greater than the seventh distance D7, the amount of a part of the roller 194 falling in the first concave part 210 when the roller 194 passes the contact point P2 and engages with the first concave part 210 is relatively small.

For example, if the first distance D1 is smaller than the seventh distance D7, the roller 194 is lifted largely by the cam 200 to move over the contact point P2, and then, the lifted amount is largely decreased and the roller 194 contacts both the contact points P1 and P2. When the roller 194 contacts the contact point P1, a large shock is generated. According to the present embodiment, since the first distance D1 is equal to or greater than the seventh distance D7, the roller 194 comes into contact with the contact point P1 while the roller 194 is slowly entering the first concave part 210, the shock generated when the roller 194 comes into contact with the contact point P1 can be made small.

In a state shown in FIG. 7A, the cam 200 slightly lifts the roller 194. Therefore, in comparison with a case shown in FIG. 6 (i.e., the strong nipping state), the heating member 191 is slightly lifted by the elastic force of the pressure roller 150, thereby a nip part N2 having a smaller width being formed. This state is the weak nipping state.

When the motor M is driven in the first state shown in FIG. 7A and the clutch 209 is connected for a particular period of time, the cam 200 rotates clockwise. When paying attention to the roller 194, the roller 194 proceeds on the cam surface 202, passing the contact point P1, such that the roller 194 rolls around the cam 200 counterclockwise.

Figure 8A:
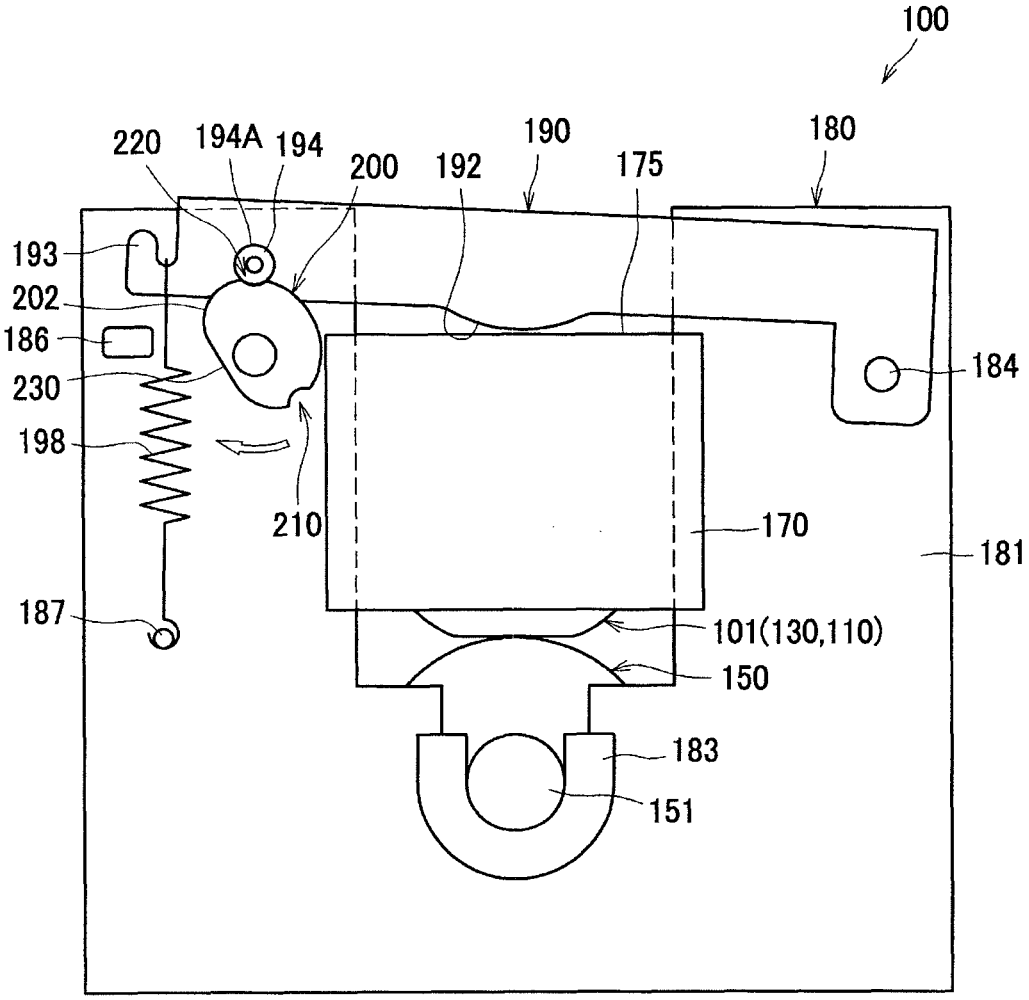
FIG. 8A is a side view of the fixing device in a nip release state according to the illustrative embodiment of the disclosures.

As shown in FIG. 8A, as the cam 200 rotates clockwise, the roller 194 is lifted by the cam surface 202. In view of the roller 194, the roller 194 smoothly proceeds on the cam surface 202 counterclockwise, and finally engages with the second concave part 220. That is, as the cam 200 rotates, the state is changed from the third state to the second state via the first state by its rotation. When the roller 194 engages with the second concave part 220, the orientation of the cam 200 is stabilized, thereby the nipping force by the heating member 101 and the pressure roller 150 being stabilized.

Figure 8B:
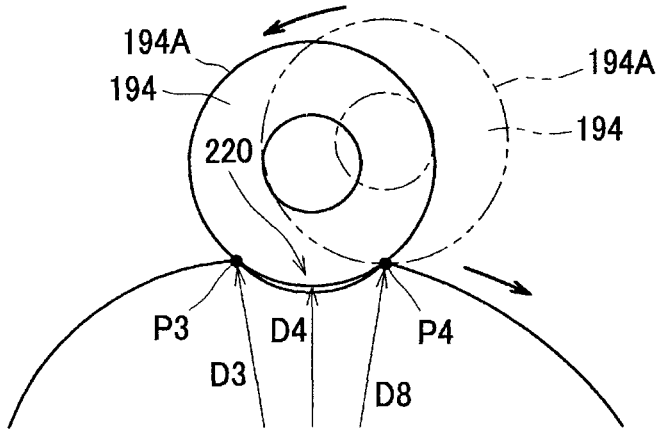
FIG. 8B is a partially enlarged side view showing a state where the roller engages with a second concave portion according to the illustrative embodiment of the disclosures.

Further, as shown in FIG. 8B, since the third distance D3 is equal to or greater than the eighth distance D8, when the roller 194 passes the contact point P4 and enters the second concave part 220, an amount by which the roller 194 falls down is relatively small. Therefore, the roller 194 slowly proceeds to gently bump the contact point P3, thereby shock generated by the contact being made small.

In the state shown in FIG. 8A, the cam 200 lifts the roller 194 by a large amount, thereby the contact point 192 of the rotatable arm 190 and the upper surface 175 of the guide member 170 being spaced. Accordingly, in comparison with the weak nipping state shown in FIG. 7A, the heating member 101 is lifted more, and is urged to contact the pressure roller 150 by its own weight. Therefore, the sheet P jammed between the heating member 101 and the pressure roller 150 can be handled easily. This state will be referred to a nip release state hereinafter.

When the motor M is further driven by the controller so as to be in the second state shown in FIG. 8A and the clutch 209 is connected for a particular period of time, the cam 200 rotates clockwise. Paying attention to the roller 194, the roller 194 rolls with respect to the cam 200 counterclockwise such that the roller 194 proceeds on the cam surface 202 and passes the contact point P3.

That is, as the cam 200 rotates clockwise, the lifting amount of the cam 200 gradually decreases and the roller 194 gradually moves down. Thereafter, when the roller 194 faces the opposite surface part 230 as shown in FIG. 6, the roller 194 is spaced from the cam surface 202 and the state returns to the third state. Thus, the state of the heating member 101 and the pressure roller 150 returns to the strong nipping state.

In the rotational movement of the cam 200, since D4>D2, the urging force of the tension spring 198 in the second state is greater than the urging force thereof in the first state. Therefore, in order to rotate the cam 200 to change the state form the second state to the third state, a larger force is required in comparison with a case where the state is changed from the first state to the second state.

However, according to the illustrative embodiment, a difference between the third distance D3 and the fourth distance D4 (i.e., D3-D4) is set smaller than a difference between the first distance D1 and the second distance D2 (i.e., D1-D2). That is, the step D3-D4 which the roller 194 should get over when the state is changed from the second state to the third state is smaller than the step D1-D2 which the roller 194 should get over when the state is changed from the first state to the second state. Therefore, in comparison with a case where the above differences are the same, the driving torque of the cam 200 can be made smaller according to the illustrative embodiment. Thus, it is prevented that the driving torque of the cam 200 from becoming unnecessarily large, thereby load to the motor M being lessened.

It is noted that the gist of the present disclosures should not be limited to the above-described illustrative embodiment, but can be modified in various ways without departing from meaning of the disclosures.

In the above-described embodiment, the cam 200 lifts up the roller 194 to lift up the rotatable arm 190, thereby the nipping force by the heating member 101 and the pressure roller 150 being weakened. This configuration may be modified such that the cam 200 is configured to lift a contacting member to weaken the nipping force between the heating member 101 and the pressure roller 150.

Figure 9:
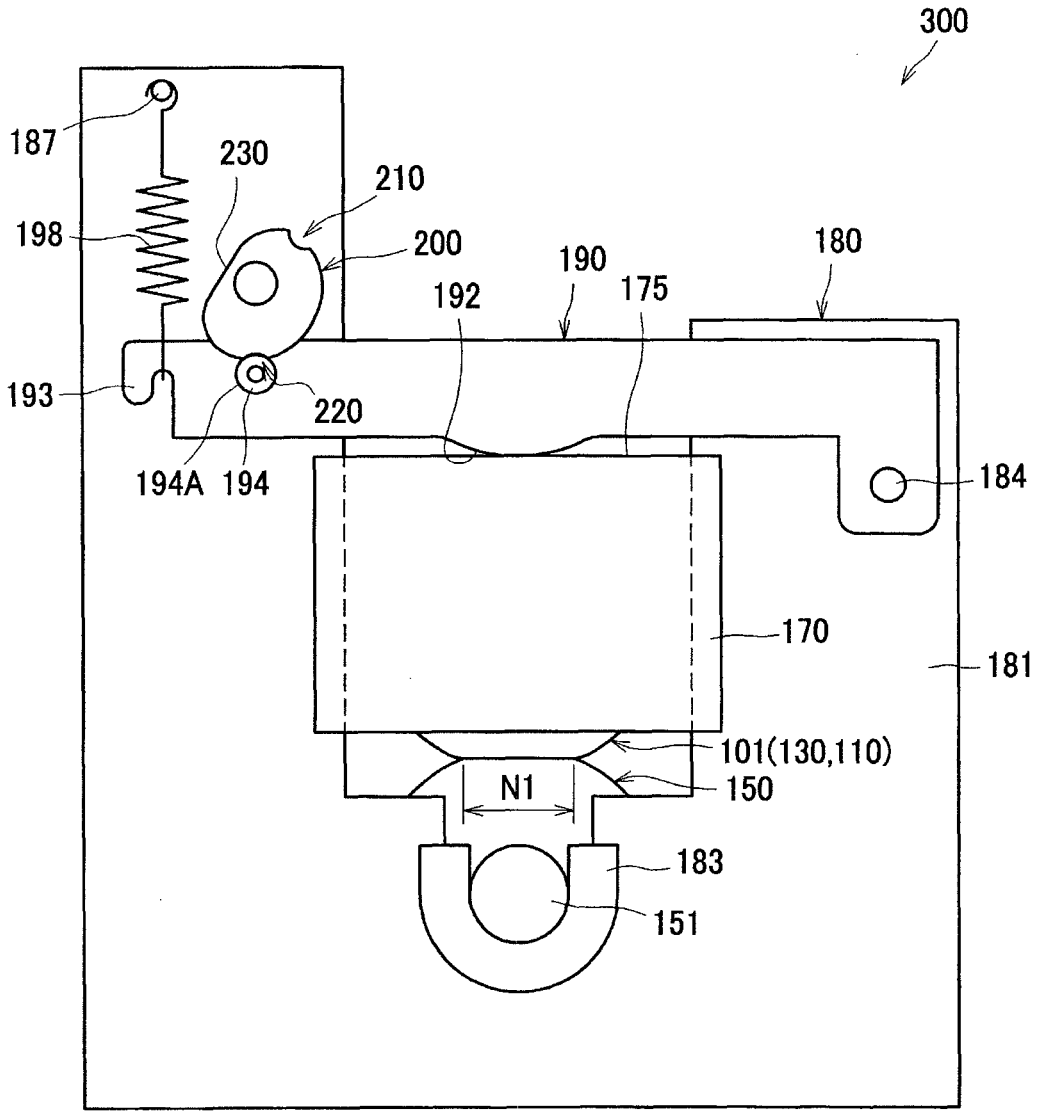
FIG. 9 is a side view of a fixing device according to a modified illustrative embodiment of the disclosures.

For example, according to a modified fixing device 300 shown in FIG. 9, the cam 200 is arranged above the roller 194, and a tension spring 198 is arranged to pull up the rotatable arm 190. In such a configuration, the strong nipping state is realized when the roller 194 engages with the second concave part 220 and is mostly lifted, the weak nipping state is realized when the roller 194 engages with first concave part 210 and slightly lifted, and the nip release state is realized when the roller 194 faces the opposite surface part 230.

In the above-described embodiment, the roller 194 is used as the contacting member. However, the contacting member may be non-rotatable member and may be provided with protrusions or the like. In such a case, a curved surface to be in contact with the cam surface may have a arc-shaped cross section.

In the above-described embodiment, the concave portion and the contacting member contact at two positions which are apart from each other in the rotation direction of the cam. It is noted that the concave portion and the contacting member may contact at more than two positions. Alternatively, the portion at which the concave portion and the contacting member contact may be formed as an area continuously connecting two positions which are spaced in the rotation direction of the cam. Optionally, the concave portion need not be limited to one having an arc-shaped cross section, but may be a groove having a V-shaped cross section, or a groove having a substantially V-shaped with a planner bottom surface (i.e., a trapezoidal cross section).

In the above-described embodiment, as concave portions provided to the cam, the first concave portion and the second concave portion are provided. This configuration may be modified to have more than two concave portions.

In the above-described embodiment, the rotatable arm 190 is configured to support the roller 194 as the contacting member, and the fixing frame 180 is configured to support the cam 200. This configuration may be modified such that, the rotatable arm 190 supports the cam 200 and the fixing frame 180 supports the contacting member.

Further, the pressing member need not be limited to the rotatable arm. That is, the pressing member may be configured to slidably move with respect to the supporting member. Further, the pressing member may be fixed to the housing of the image forming apparatus, and the supporting member may be configured to move relative to the housing.

Further, in the above-described embodiment, the fixing frame 180 is an example of the supporting member. It is noted that, in addition to the fixing frame 180, the housing 2 to which the fixing frame 180 is fixed, and other members fixed to the housing 2 can also be regarded as a part of the supporting member. Further, for example, the cam may be provided to the housing 2 as a part of the supporting member or a member fixed to the housing 2, or an end of the urging member may be fixed thereto.

In the above-described embodiment, as the heating member, one employing the fixing belt is shown. However, the heating member may be a rotating heat roller. Further, as the backup member, the pressure roller 150 is indicated, the backup member may be a belt-type pressing member or the like.

In the above-described embodiment, as the recording sheet, the normal sheet or the post cards are described, the recording sheet may be an OHP (overhead projector) sheet.

In the above-described embodiment, the laser printer 1 is explained as an example of the image forming apparatus provided with the fixing device according to aspects of the disclosures. For example, the image forming apparatus may be an LED printer using LEDs as an exposure device. Further, the image forming apparatus may be a copier or an MFP (multi-function peripheral) other than the printer. Further, in the above-described embodiment, the image forming apparatus is configured to form a monochromatic image. However, the image forming apparatus need not be limited to such a configuration, and may be one forming a color image.

What is claimed is:

1. A fixing device configured to thermally fix a developer image on a recording sheet, comprising:

a heating member;

a backup member configured to nip the recording sheet in association with the heating member;

a supporting member configured to support one of the heating member and the backup member;

a pressing member configured to urge another of the heating member and the backup member toward the one of the heating member and the backup member;

an urging member configured urge the pressing member toward the supporting member;

a cam provided to the one of the supporting member and the pressing member;

a contacting member having a curved surface to contact an outer periphery of the cam and provided to the other of the supporting member and the pressing member, wherein the cam has at least two concave portions formed on the outer periphery of the cam at different portions apart from each other in a rotation direction of the cam, each of the at least two concave portions being configured to contact and engage with the curved surface, wherein the at least two concave portions include a first concave portion and a second concave portion which is spaced from the first concave portion in the rotation direction of the cam by a particular amount, wherein the fixing device is configured to satisfy following relationships:

$$D4>D2, \text{ and}$$

$$D3-D4<D1-D2,$$

wherein D1 and D2 are distances viewed along the rotation axis of the cam in a first state in which the curved surface engages with the first concave portion, D3 and D4 are distances viewed along the rotation axis of the cam in a second state in which the curved surface engages with the second concave portion, D1 represents, a first distance which is a distance from a most upstream contact point in the rotation direction to a rotation axis of the cam which is the center of rotation of the cam, D2 represents a second distance which is the shortest distance from the rotation axis to the curved surface, D3 represents a third distance which is a distance from a most upstream contact point in the rotation direction of the cam to the rotation axis, and D4 represents a fourth distance which is the shortest distance from the rotation axis to the curved surface.

2. The fixing device according to claim 1, further configured to satisfy a following relationship:

$$D5>D6,$$

wherein D5 and D6 are distances viewed along the rotation axis of the cam, D5 represents a fifth distance which is a distance from the most upstream contact point to the most downstream contact point in the rotation direction in the first state, and D6 represents a sixth distance which is a distance from the most upstream contact point to a most downstream contact point in the rotation direction in the second state.

3. The fixing device according to claim 2, further configured to satisfy following relationships:

$$D1>D7; \text{ and}$$

$$D3>D8,$$

where, D7 and D8 are distances viewed along the rotation axis of the cam, D7 represents a seventh distance which is a distance from the most downstream contact point in the rotation direction to the rotation axis in the first state, and D8 represents an eighth distance which is a distance from the most downstream contact point in the rotation direction to the rotation axis in the second state.

4. The fixing device according to claim 3, wherein the first concave portion is configured to contact and engage with the curved surface at two positions which are shifted in the rotation direction of the cam, and wherein the second concave portion is configured to contact and engage with the curved surface at two positions which are shifted in the rotation direction of the cam.

5. The fixing device according to claim 4, wherein the first concave portion is arc-shaped having a first radius of curvature R1 when viewed along the rotation axis of the cam and the second concave part is arc-shaped having a second radius of curvature R2 when viewed along the rotation axis of the cam, and the curved surface has a third radius of curvature R3 when viewed long the rotation axis of the cam, and wherein the fixing device is further configured to satisfy a following relationship:

$R3>R2>R1$.

6. The fixing device according to claim 5, wherein a nipping force between the heating member and the backup member in a third state which is a state where the cam is out of contact with the contacting member is greater than the nipping force between the heating member and the backup member in the first state, and wherein the heating member is spaced from the backup member in the second state.

7. The fixing device according to claim 6, further comprising a motor configured to drive the cam to rotate in the rotation direction and an element which is different from the cam.

8. The fixing device according to claim 6, wherein the contacting member is a roller supported by one of the supporting member and the pressing member.

9. The fixing device according to claim 1, wherein the first concave portion is configured to contact and engage with the curved surface at two positions which are shifted in the rotation direction of the cam, and wherein the second concave portion is configured to contact and engage with the curved surface at two positions which are shifted in the rotation direction of the cam.

10. The fixing device according to claim 1, wherein the first concave portion is arc-shaped having a first radius of curvature R1 when viewed along the rotation axis of the cam and the second concave part is arc-shaped having a second radius of curvature R2 when viewed along the rotation axis of the cam, and the curved surface has a third radius of curvature R3 when viewed long the rotation axis of the cam, and wherein the fixing device is further configured to satisfy a following relationship:

$R3>R2>R1$.

11. The fixing device according to claim 1, wherein a nipping force between the heating member and the backup member in a third state which is a state where the cam is out of contact with the contacting member is greater than the nipping force between the heating member and the backup member in the first state, and wherein the heating member is spaced from the backup member in the second state.

12. The fixing device according to claim 11, wherein the rotation direction of the cam is a direction along which the state changes from the third state to the second state through the first state.

13. The fixing device according to claim 12, wherein a rotation angle of the cam from the first state to the second state in the rotation direction is greater than a rotation angle of the cam from the third state to the first state in the rotation direction.

14. The fixing device according to claim 1, further comprising a motor configured to drive the cam to rotate in the rotation direction and an element which is different from the cam.

15. The fixing device according to claim 1, wherein the contacting member is a roller supported by one of the supporting member and the pressing member.

* * * * *